United States Patent [19]

Reick

[11] 4,199,142

[45] Apr. 22, 1980

[54] TOYS AND GAMES USING SUPER-HYDROPHOBIC SURFACES

[75] Inventor: Franklin G. Reick, Westwood, N.J.

[73] Assignee: Michael Ebert, Mamaroneck, N.Y.; a part interest

[21] Appl. No.: 897,744

[22] Filed: Apr. 17, 1978

Related U.S. Application Data

[62] Division of Ser. No. 682,146, Apr. 30, 1976, Pat. No. 4,142,724.

[51] Int. Cl.[2] ..... A63F 7/04; A63H 23/00; A63H 33/00; A63G 21/00

[52] U.S. Cl. ..... 273/109; 46/1 J; 46/43; 272/56.5 R; 273/DIG. 29

[58] Field of Search ..... 273/126 R, 108, DIG. 29, 273/1 L, 109, 114; 46/43, 201, 1 J; 272/56.5 R, 56.5 SS, 1 B; 104/70, 73

[56] References Cited

U.S. PATENT DOCUMENTS

| | | | |
|---|---|---|---|
| 2,982,547 | 5/1961 | Carrier | 273/56.5 R |
| 3,690,265 | 9/1972 | Horibata | 104/73 X |
| 3,970,300 | 7/1976 | Becker et al. | 273/56.5 R X |

FOREIGN PATENT DOCUMENTS

| | | | |
|---|---|---|---|
| 7697 | of 1902 | United Kingdom | 273/126 R |

OTHER PUBLICATIONS

Cabot Corp. Publication, received Feb. 20, 1975.

*Primary Examiner*—George J. Marlo
*Attorney, Agent, or Firm*—Michael Ebert

[57] ABSTRACT

A toy, game or other play device wherein a trackway, slide, maze or other play surface is coated with superhydrophobic material that is highly water repellent, whereby a drop of water applied thereto forms into a ball that can then be manipulated by a player to carry out predetermined play activities. Alternatively, a tiny vehicle or other toy body having a hydrophilic coating thereon may be wetted with water and placed on the super-hydrophobic surface whereby the slightest force applied thereto causes the body to skim at high speed over the surface. The toy body may be in the shape of an arrow which can be caused to move along the playing surface, when tilted, and come to rest at a particular number, word or symbol provided on the playing surface.

7 Claims, 5 Drawing Figures

FIG. 1
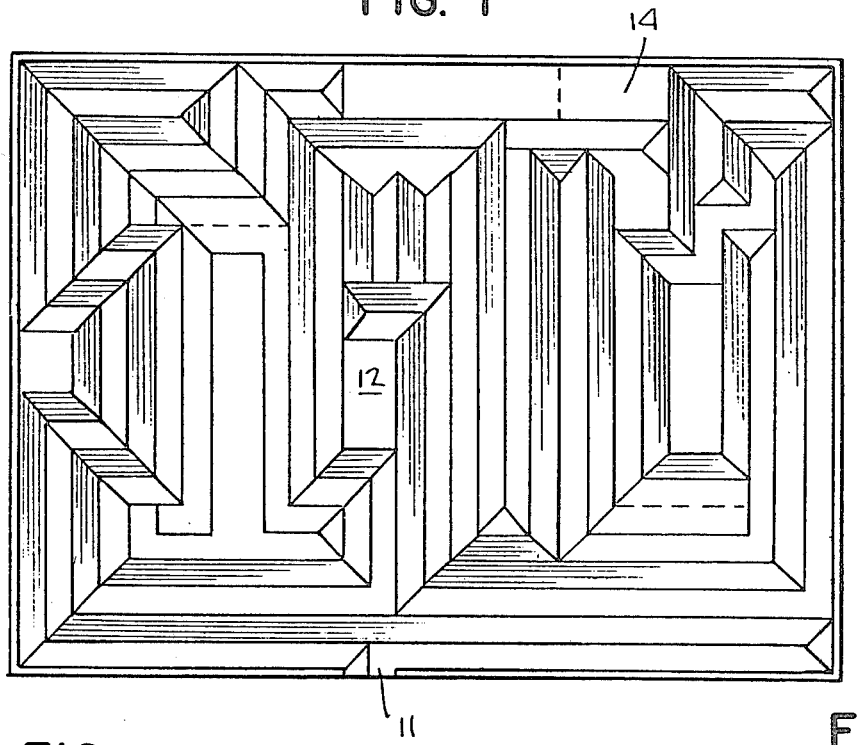
FIG. 2
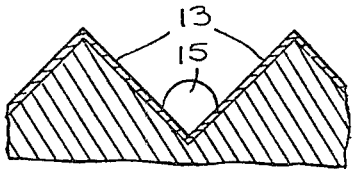
FIG. 3
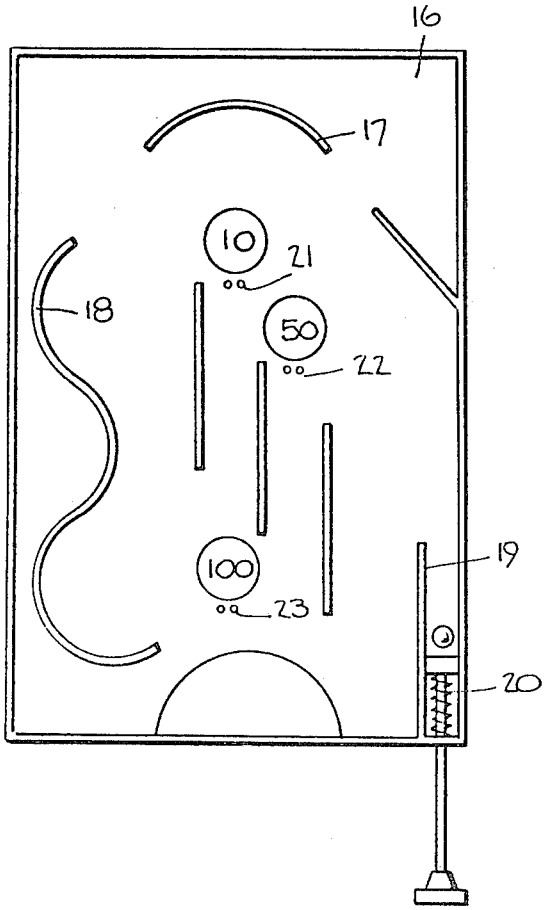
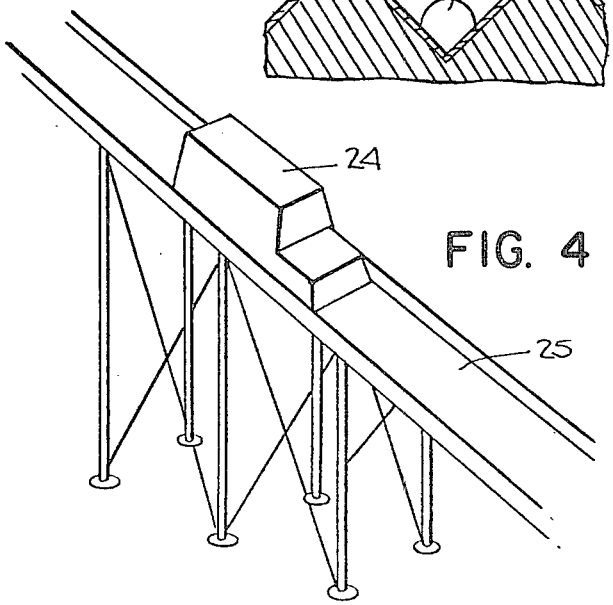
FIG. 4
FIG. 5
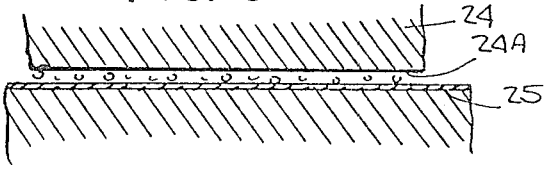

TOYS AND GAMES USING SUPER-HYDROPHOBIC SURFACES

RELATED APPLICATION

This application is a division of my copending application Ser. No. 682,146, filed Apr. 30, 1976, now U.S. Pat. No. 4,142,724, entitled "Toys and Games Using Super-Hydrophobic Surfaces."

BACKGROUND OF THE INVENTION

This invention relates generally to toys, games, and other play devices, and more particularly to play devices which exploit and behavior of water on superhydrophobic surfaces.

A hydrophobic substance is one having a distinct tendency to repel water in a manner usually characteristic of non-wetted, oily, waxy or fatty materials. A hydrophobic surface will normally not sustain a water film, even one of monomolecular thickness. This property not only is found in all oils, fats, waxes and many resins, but also in finely divided powder such as carbon black and magnesium carbonate.

A hydrophilic substance has a strong affinity for water by absorption or adsorption even to the point of gradual liquifaction by extracting water vapor from the atmosphere. This property is characteristic of carbohydrates such as algin, vegetable gums, pectins and starches as well as complex proteins like gelatin and albumen.

The present invention deals with a hydrophobic layer formed on a substrate, which layer incorporates particles of hydrophobic fumes silicon dioxide (HFSD). Silicon dioxide particles are produced by the hydrolysis of silicon tetrachloride in a flame process. The fumed silicon dioxide particle is hydrophilic in nature by reason of the large number of hydroxyl groups present on the surface. These particles are rendered hydrophobic by reacting them with a silane. During the reaction, hydrophobic hydrocarbon groups replace many of the hydroxyl groups, the resulting particles offering increased compatibility with organic or non-polar media and a corresponding repulsion to water. One commercially available form of hydrophobic fumed silicon dioxide powder is manufactured and sold by Cabot Corporation of Boston, Mass., under the trademark "Silanox."

Silane, which is a member of the silicone family, contributes its inherent hydrophobicity and oleophilicity to the HFSD particle. Fumed silicon dioxide, which is a fine pure powder, brings to HFSD a particle of extremely small size and enormous surface area, all of it being accessible for interaction with the surrounding media. In protective coatings, the hydrophobicity derived from the silane component of HFSD is augmented by the surface micro-roughness imparted by the silicon dioxide component, giving rise to a degree of water repellency so great that it is often referred to as super-hydrophobicity.

Substrates coated with HFSD repel water to an extraordinary degree. An air layer becomes entrapped between the substrate and the water and is visible as a reflected silvery sheen. This air layer or shield is sometimes referred to as a gaseous plastron.

The super-hydrophobic properties of HFSD can be imparted to substrates in various ways. HFSD particles can, for example, be applied in dry form on tacky surfaces, or it can be applied from a liquid dispersion. But regardless of the mode of applying HFSD to the substrate, it is important that these particles remain essentially uncoated and exposed at the solid-water interface to afford the micro-roughness necessary for optimum super-hydrophobicity.

One serious difficulty often encountered in HFSD coatings is its poor abrasion resistance, for if the coating is subjected to wear, it may be eroded, with a consequent loss of super-hydrophobicity and a possible gain in hydrophilic properties should the underlying substrate by hydrophilic in character.

In applicant's above-identified copending application and patent, there is disclosed a technique for coating substrates to render the face thereof super-hydrophobic, the resultant face being highly abrasion and scratch resistant.

This is accomplished by applying to the face of a substrate which has a micro-rough surface, particles of hydrophobic fumed silicon dioxide dispersed in a solvent within which is dissolved a resinous binder whose amount, by weight, is substantially less than one-half of the amount of particles in the dispersion. Upon volatilization of the solvent, the resultant coating is composed predominantly of fumed silicon dioxide particles strongly bonded to the face of the substrate.

SUMMARY OF INVENTION

In view of the foregoing, it is the main object of this invention to provide toys, games and other play and entertainment devices which exploit the super-hydrophobic properties of surfaces treated in the manner disclosed in said co-pending application and patent.

More particularly, it is an object of this invention to provide toys, games and other play and entertainment devices which exploit the super-hydrophobic properties of surfaces treated in the manner disclosed in said copending application and patent.

Also an object of this invention is to provide play devices which exploit the natural repulsion existing between hydrophobic and hydrophilic surfaces to create an air cushion therebetween which minimizes friction encountered in a sliding movement of the hydrophilic surface relative to the hydrophobic surface.

OUTLINE OF DRAWING

For a better understanding of the invention as well as other objects and further features thereof, reference is made to the following detailed description to be read in conjunction with the accompanying drawings, wherein:

FIG. 1 is a plan view of a water-ball maze in accordance with the invention;

FIG. 2 is a section of a channel included in the maze;

FIG. 3 is a plan view of a water-ball pinball-type machine in accordance with the invention;

FIG. 4 is a sketch of a slide in which the hydrophilic surface of a vehicle engages the super-hydrophobic surface of a trackway in accordance with the invention; and FIG. 5 illustrates the relationship between the hydrophilic and hydrophobic surfaces of the arrangement shown in FIG. 4.

DESCRIPTION OF INVENTION

The Super-Hydrophobic Surface

In determining the degree of hydrophobicity presented by a given surface, one must take into account two opposing forces. First there is the force of cohesion which is present in the water on the surface, this cohesive force causing water molecules to attract each other. The second force acting on the water is the force of adhesion which causes water molecules to attract the atoms or molecules on the surface. The relationship between these two opposing forces determines the degree of wetting of the surface by the water.

On a normally hydrophobic surface, such as wax paper, a drop of water retains its integrity, but there is sufficient surface adhesion to cause the drop to assume a somewhat flattened form on the wax paper. On a superhysdrophobic surface formed by an HFSD coating or layer, the shape of the water drop is almost spherical, in that the force of adhesion is almost negligible. On a completely wettable and hydrophilic surface, the force of adhesion is stronger than the force of cohesion and a water drop will quickly spread to cover the surface. Thus with hydrophobic surfaces the cohesive force is dominant, and in such surfaces water droplets tend to draw together, whereas in the hydrophilic surfaces the adhesive force is greater and overcomes the cohesive force.

Two factors come into play in determining the degree to which a surface is hydrophobic. First there is the chemical factor which is why oily, waxy or fatty materials repel water. But there is also a physical factor; for when surface roughness is present to create minute projections or fibrils, a water droplet tends to be supported only on the peaks of the projections. The air-filled troughs between the projections are free from contact with the water, thereby enhancing hydrophobicity. Exceptional water repellency or super-hydrophobicity may therefore be obtained by a merger of surface chemistry and micro-roughness. This phenomenon is often encountered in nature, such as on leaves and petals wherein a multiplicity of tiny hydrophobic fibrils act to repel water, thereby facilitating transpiration.

In the present invention, both the chemical and physical factors are exploited to provide a super-hydrophobic layer which is abrasion and scratch resistant and cannot easily be rubbed off, whereby the characteristics of the layer are maintained under rigorous operating conditions. In order to accomplish this result, it is essential that the substrate which is coated with HFSD also exhibit hydrophobic properties. We shall, therefore, first consider the nature of the substrate.

Substrates

One preferred form of substrate material is a layer of foam plastic formed of polyethylene or polypropylene having a very fine cell structure. Usable for this purpose is "Minicel" L-200, crosslinked polyethylene foam manufactured and sold by Hercules Incorporated of Wilmington, Del. A block of such foam material is skived to provide a layer sheet, thereby cutting open the cells in the face of the layer to create a multiplicity of fine pockets. As a consequence of these fine pockets, the face of the layer presents a myriad of cut-ends or projections which are inherently hydrophobic in character.

Another useful form of substrate is spunbonded olefin formed of high-density polyethylene fibers. Sheets or layers of this material are formed by first spinning continuous strands of very fine interconnected fibers and then bonding them together with heat and pressure. Though the dense packing of the fine, interconnected fibers produces a seemingly smooth surface, the surface is actually porous and has a very fine fuzz or uncut pile face which imparts thereto hydrophobic properties. One commercial form of spunbonded olefin is manufactured and sold by the DuPont Company under the trademark "TYVEK." As noted in the DuPont Technical Information Bulletin S-9, published March 1973, "The Properties and Processing of Tyvek Spunbonded Olefin," this material is inherently hydrophobic.

Similar characteristics are found in spunbonded polyester sheets or layers formed by continuous filament polyester fibers that are randomly arranged, highly dispersed and bonded at the filament junctions. When these fibers are crimped, the resultant surface is fuzzy, imparting thereto a high degree of hydrophobicity. This product, which is manufactured and sold by DuPont under the trademark REEMAY, is described in the DuPont Technical Bulletin S-4, dated April 1970, "Properties and Processing of REEMAY Spunbonded Polyester."

In summary, the substrate to be coated by HFSD is formed of a material which is chemically hydrophobic and which has a micro-rough face which is physically hydrophobic, so that both hydrophobic factors are combined in the fine hairs or projections which constitute the face of the material. The term "micro-rough" as used in the specification and claims is intended to encompass an facial texture which is physically hydrophobic, such as cusps, piles, projections, cut-ends, flock and fibrils.

Substrate Coatings

The face of the substrate is sprayed or otherwise coated with hydrophobic fumed silicon dioxide particles dispersed in a solvent that is chemically hydrophobic, within which solvent is dissolved a resinous, thermoplastic binder that is chemically hydrophobic. Thus when the coating is dried or cured, all constituents thereof, including trace elements, are hydrophobic in character, and the resultant treated substrate is super-hydrophobic and highly resistant to abrasion and other damaging effects. Thus even when an area of the super-hydrophobic surface becomes eroded, the exposed area remains hydrophobic, and in no instance is a hydrophilic area created because of wear or abrasion.

A preferred form of HFSD is Silanox 101 manufactured by Cabot Corporation, which is a silane-modified silicon dioxide in finely divided powder form. The surface of this powder is 225 $m^2/gm$ (BET), the primary particle size is $7\mu$, and the bulk density is 3 lbs. per cubic foot.

In order to form a dispersion of the HFSD particles, use is made of a solvent which is inherently hydrophobic and capable of dissolving the binder for the HFSD particles. A preferred solvent for this purpose is trichloroethylene (CH C1: $CCl_2$), which is a stable, colorless heavy liquid derived from tetrachloroethane by treatment with lime or alkali in the presence of water, or by thermal decomposition followed by steam distillation. Also usable as a solvent is perchloroethylene ($Cl_2$ C: $CCl_2$) or benzene ($C_6H_6$).

The preferred form of binder which is dissolved in the solvent is high impact polystyrene ($C_6H_5CHCH_2$), which is a thermoplastic synthetic resin of variable molecular weight depending on the degree of polymerization. Also usable as a binder are polyvinyl resin or copolymers of ethylene and vinyl acetate. These binders are all thermoplastic in nature and have hydrophobic properties.

It is important that the amount of binder by weight be no more than is necessary to effectively bond the HFSD particles to the face of the substrate so that the resultant covering is predominantly HFSD and is super-hydrophobic. Thus the ratio of the binder by weight to the HFSD particles must be less than 50:50.

One acceptable formulation for the dispersion is the following:

Solvent—1500 cc of trichloroethylene
Binder—20 grams of high impact polystyrene
HFSD—35 grams of Silanox In practice, the amount of binder in this formation may be further reduced to as low as 10 grams relative to 35 grams of Silanox.

In preparing the dispersion, the binder is first fully dissolved in the solvent, and then the HFSD particles are added to the solvent in a Waring blender or other suitable mixer and stirred therein for a few seconds to completely disperse same without excessive agitation. In applying this dispersion to the face of a substrate, a wet spray technique may be used. When the solvent volatilizes, strongly bound to the fibrils or the cut-ends of the substrate face is a fine coating containing HFSD particles. The resultant surface is extraordinarily water-repellent and resistant to abrasion and other wear conditions.

In those instances where the surface may be subjected to very heavy wear, its abrasion resistance may be augmented by a calendering technique in which the treated surface is run under a heated pressure roll, pressing the coating into more intimate relationship with the substrate without, however, impairing the character of the substrate. In this operation the calendering temperature and pressure conditions must be such as to avoid fusing the fibrils of the substrate.

Toys Having Super-Hydrophobic Surfaces

Referring now to FIG. 1, there is shown a molded maze 10 in accordance with the invention having an entrance 11 and a home base 12 which communicates with the entrance through a circuitous path forming a pattern of passages or channels. These channels are defined by passage walls 13 projecting above a ground plate 14. The path is complicated by many blind alleys, so that it is difficult to find the way to home base 12.

Instead of using a solid ball or other element to traverse the winding path of the maze, the molded walls and ground plate of the maze which constitute a substrate are coated with a super-hydrophobic material of the type previously described, and a large drop of water is introduced at the entrance, the drop being converted by the surface into a waterball 15. This ball may be directed through the passages by tilting the maze in various ways to direct the ball into selected passages in order to reach home base.

As shown in FIG. 2, the channels are given a V-shaped configuration. As a consequence of internal light reflection in the water ball against the inclined walls 13 of the channels, mirror-like or silvery effects are produced which cause the water-ball to glitter or sparkle. Pigment may be added to the water to enhance the attractiveness of the water-ball.

In the game shown in FIG. 3, a pin-ball type playboard 16 is used with various obstacles, such as deflectors 17 and 18 on the board to deflect the water-balls. However, instead of solid balls as in conventional pin-ball machines, drops of water are introduced into the shooting chamber 19 associated with a spring-actuated retractable plunger 20. When the plunger is released, it propels the water balls into the play area, the balls being deflected in various directions. The entire working surface of the pin-ball machine is coated with superhydrophobic material of the type previously disclosed so that the water-balls retain their ball-like integrity, even though on impact with a given obstacle, the large ball may be dissected into a multiplicity of small water-balls.

In order to effect scoring by means of electricallyactuated lights and digits and other effects common to pin-ball machines, electrical contact pairs 21, 22, 23 are disposed at various points on the board. Each pair is connected to an electronic relay to actuate the appropriate indicators or display elements when the pair is bridged by a water ball.

To provide a shunt path when a pair of contacts is bridged by a water-ball, the water used may include salt in solution or other substances enhancing the conductivity of the water. Or use may be made of a high-impedance electronic relay, such as a Darlington amplifier which is rendered operative when a relatively low resistance water path bridges the associated pair of contacts.

In the slide arrangement shown in FIGS. 4 and 5, a travel toy 24 in simulated vehicular form is adapted to slide on an inclined tracking 25. The undersurface of toy 24 which engages the track is formed of hydrophilic material and is made wet before use so that a thin film of water 24A is formed thereon. The track 25 is coated with a layer of hydrophobic material 25A which repels the water film on the vehicle to create minute air cushions thereon, whereby the toy, which may be in sled or in any other fanciful form, effectively floats on the roadway and the sliding resistance thereto is virtually nil.

As a consequence, the slightest applied force or the force of gravity causes the vehicle to travel at high speed for long distances limited only by the length of the toy track. Or one could, by means of a retractable, spring-biased plunger, shoot a wet ball or other missile having a hydrophilic surface along a treated track of this type.

Another version (not shown) of a hydrophilic/hydrophobic play device is a movable element in arrow form whose undersurface is hydrophilic and wetted so that it slides freely on the super-hydrophobic surface of a board having numbers, words, letters or other symbols printed thereon, so that the arrow effectively floats on the board. The position of the arrow is manipulated by the player by slightly tilting the board so that the arrow skims across the board until it comes to rest at a particular number, word or symbol.

While there have been shown and described preferred embodiments of toys and games using super-hydrophobic surfaces in accordance with the invention, it will be appreciated that many changes and modifications may be made therein without, however, departing from the essential spirit thereof.

I claim:

1. A toy or game device comprising:

A a dry playing board having an exposed planar face layer formed by hydrophobic material that repels water; and B a play element set in motion by a player to slide on the face layer of said board, said play element having an underface formed by hydrophilic material having an affinity for water, said underface being planar and being wettable by water which is repelled by said planar face layer to create a minute air film between the face layer and the play element whereby said element effectively floats on said dry board with virtually no slide resistance.

2. A device as set forth in claim 1, wherein said board is a track and said element is in simulated vehicular form adapted to slide on said track.

3. A device as set forth in claim 2, wherein said track is inclined to provide a gravity slide.

4. A device as set forth in claim 2, further including means to shoot said element to slide at high speed along said track.

5. A device as set forth in claim 1, wherein said element is in arrow form and slides with respect to different symbols printed on said board whereby when said arrow is at rest it indicates a particular symbol.

6. A device as set forth in claim 1, wherein said face layer is super-hydrophobic.

7. A device as set forth in claim 6, wherein said super-hydrophobic face layer includes fumed silicon dioxide.

* * * * *

UNITED STATES PATENT OFFICE

CERTIFICATE OF CORRECTION

Patent No. 4,199,142 Dated April 22, 1980

Inventor(s) Franklin G. Reick

It is certified that error appears in the above-identified patent and that said Letters Patent are hereby corrected as shown below:

Column 1, line 14 "and" should have read -- the --

Column 1, line 33 "fumes" should have read -- fumed --

Column 2, line 11 "by" should have read -- be --

Column 3, line 12 "superhysdrophobic" should have read -- superhydrophobic --

Column 4, line 26 "an" should have read -- any --

Column 6, line 9 "electricallyac-" should have read -- electrically-ac- --

Signed and Sealed this

*Twenty-first* Day of *October 1980*

[SEAL]

*Attest:*

SIDNEY A. DIAMOND

*Attesting Officer*

*Commissioner of Patents and Trademarks*